US005401929A

United States Patent [19]

Chen

[11] Patent Number: 5,401,929

[45] Date of Patent: Mar. 28, 1995

[54] STRUCTURE OF COMPUTER KEY SWITCH

[76] Inventor: Pao-Chin Chen, 4F., No. 292, Sec. 2, Chien Kuo S. Road, Taipei, Taiwan, Prov. of China

[21] Appl. No.: 144,146

[22] Filed: Oct. 27, 1993

[51] Int. Cl.[6] ..... H01H 13/14

[52] U.S. Cl. ..... 200/534

[58] Field of Search ..... 200/517, 534, 292, 345

[56] References Cited

U.S. PATENT DOCUMENTS

| | | | |
|---|---|---|---|
| 4,453,061 | 6/1984 | Tamura | 200/534 X |
| 4,467,150 | 8/1984 | Leitermann et al. | 200/292 X |
| 4,492,838 | 1/1985 | Fukukura | 200/517 |
| 4,641,004 | 2/1987 | Keprda | 200/534 |
| 5,172,990 | 12/1992 | Weng | 200/345 X |

*Primary Examiner*—Renee S. Luebke

*Attorney, Agent, or Firm*—Bucknam and Archer

[57] ABSTRACT

A computer key switch consisting of a key cap, a locating plate, a key body, a rubber cone, and a printed circuit board, wherein the key cap has two bottom rods movably inserted into two pin holes on the key body and two corresponding pin holes in the circuit board, two bottom hooks movably hooked in two retaining holes on the key cap and passable through two corresponding through holes in the circuit board, and a bottom plunger disposed in line with the center through hole on the key body and forced to squeeze the rubber cone; the key body protrudes over a hole on the locating plate, having an outward bottom flange retained between the locating plate and the printed circuit board and two opposite stop rods stopped against the locating plate at the top; the rubber cone is received within the key body and driven by the plunger of the key cap to electrically connect a circuit on the printed circuit board.

1 Claim, 3 Drawing Sheets

STRUCTURE OF COMPUTER KEY SWITCH

BACKGROUND OF THE INVENTION

The keyboard in a computer system is a device for data input, which consists of a set of keys. Once a key is pressed, a specific circuit is connected to produce a specific input signal. Regular computer keyboards may be arranged into two groups, one is the mechanical type and the other is the membrane type. In a mechanical keyboard, the keys can be conveniently arranged according to the layout of the printed circuit board. As illustrated in FIG. 1, the two pins of the key switch are inserted through holes on the printed circuit board and welded in place. This mechanical key switch is expensive to manufacture and simultaneously increases the total thickness of a keyboard. Furthermore, this mechanical key switch may be damaged easily because it triggers a signal by striking.

FIG. 2 illustrates a membrane key switch according to the prior art, in which a support is formed on a frame above a membrane and a plate to support a key cap by a rubber base plate thus permitting the plunger of the key cap to be inserted through a hole in the frame. This arrangement greatly reduces the total thickness of a keyboard. However, because the post is directly formed on the frame, precision is very critical. Once the layout is fixed, the arrangement of the key switches on a keyboard can no longer be changed. Therefore, the tooling charge for a membrane keyboard is very expensive, and high degree of risk is involved in making a mold according to the desired layout. This type of membrane keyboard is commonly used for notebook computers.

SUMMARY OF THE INVENTION

The present invention has been accomplished to provide a structure of computer key switch which eliminates the aforesaid disadvantages. According to the preferred embodiment of the invention, the computer key switch is comprised of a printed circuit board, a locating plate spaced above the printed circuit board, a rubber cone supported on the printed circuit board, a key body mounted on the printed circuit board to hold the rubber cone, and a key cap mounted on the key body. The key cap has two bottom rods movably inserted into two pin holes on the key body, two bottom hooks movably hooked in two retaining holes on the key body, and a bottom plunger disposed in line with the center through hole on the key body and adapted to squeeze the rubber cone. The key body has an outward bottom flange retained between the printed circuit board and the locating plate, and two downward directed stop rods on two opposite sides thereof respectively stopped against the locating plate at the top. The rubber cone is received within the key body, having an annular top flange extended into the center through hole on the key body and stopped against the bottom plunger of the key cap, and a conductive rubber on the inside to electrically connect a switch on the printed circuit board upon each down stroke of the bottom plunger. The printed circuit board further comprises two opposite pin holes and two opposite through holes corresponding to the pin holes and retaining holes on the key cap for passing the bottom rods and bottom hooks of the key cap upon each down stroke of the bottom plunger of the key cap. Therefore, the total thickness of the key switch is greatly reduced.

DETAILED DESCRIPTION OF THE PREFERRED EMBODIMENT

Figure 1:
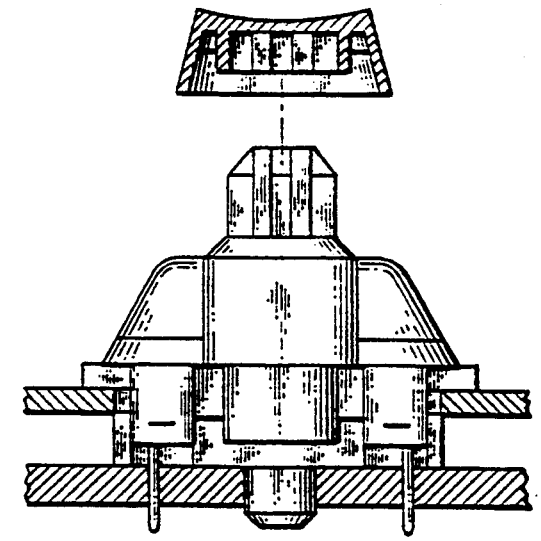
FIG. 1 (PRIOR ART)
FIG. 1 illustrates a key switch for a mechanical keyboard according to the prior art.
Figure 2:
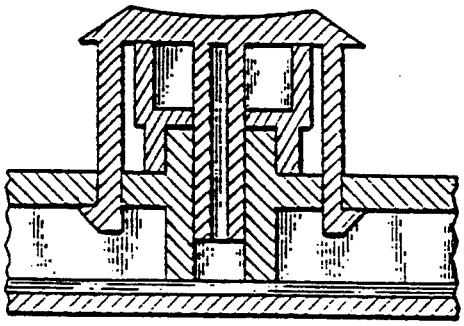
FIG. 2 (PRIOR ART)
FIG. 2 illustrates a key switch for a membrane keyboard according to the prior art.
Figure 3:
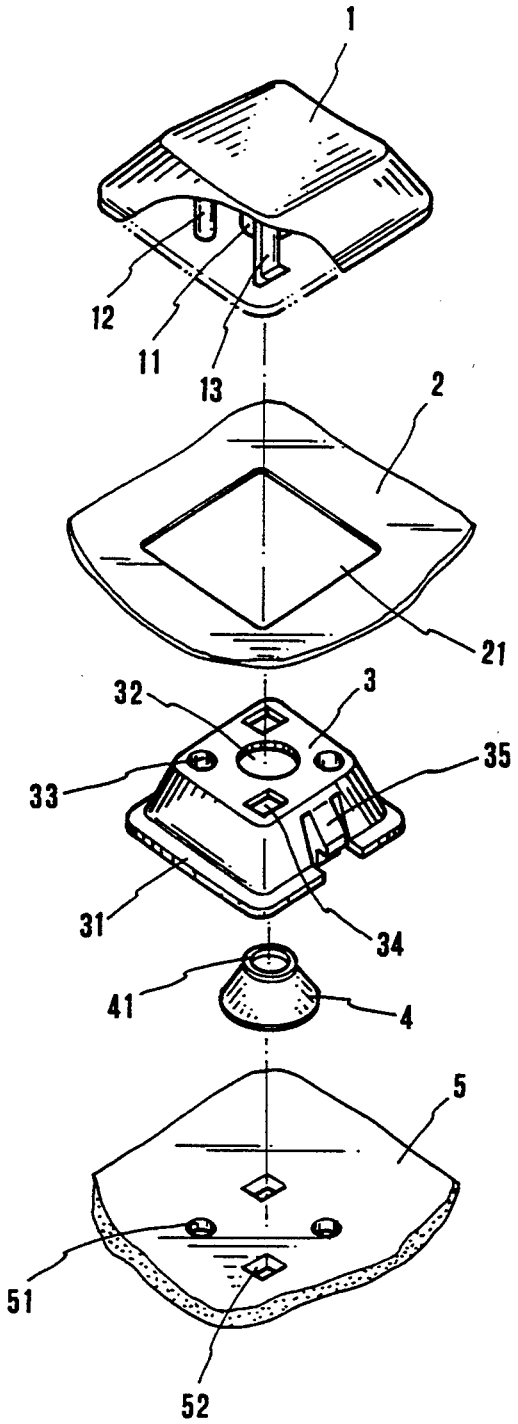
FIG. 3 is an exploded view of a key switch embodying the present invention.
Figure 4:
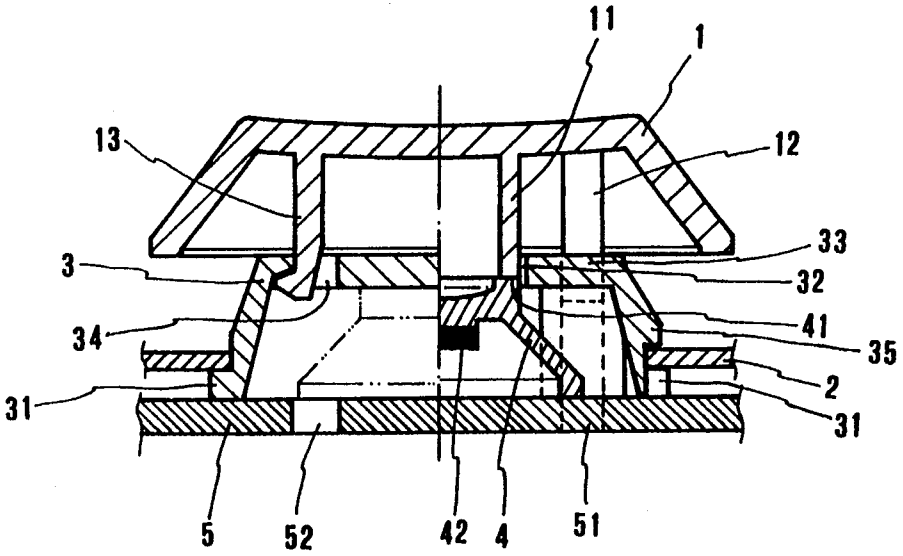
FIG. 4 is a sectional assembly view of the key switch of FIG. 3.

Referring to FIGS. 3 and 4, a key switch as constructed in accordance with the present invention is generally comprised of a key cap 1, a locating plate 2, a key body 3, a rubber cone 4, and a printed circuit board 5. The key cap 1 is comprised of a cylindrical bottom plunger 11 in the center, two opposite bottom rods 12 and two opposite bottom hooks 13 vertically extending downwardly from the bottom thereof and alternatively spaced around the bottom plunger 11. The locating plate 2 is mounted above the printed circuit board 5 to hold the key body 3 on the printed circuit board 5, having a key body slot 21 through which the key body 3 projects. The key body 3 is made in the shape of a hollow, truncated, square block gradually smaller toward the top, having an outward bottom flange 31 around the bottom thereof engaged with the locating plate 2 around the key body slot 21 at the bottom, a center through hole 32, two opposite pin holes 33 and two opposite retaining holes 34 alternatively spaced around the center through hole 32, and two opposite downward stop rods 35 on two opposite sides thereof respectively stopped above the locating plate 2. The rubber cone 4 is made gradually reducing or tapered toward the top, having an annular top flange 41 extending into the center through hole 32 on the key body 3, and a conductive rubber 42 on the inside. The printed circuit board 5 comprises two opposite pin holes 51 respectively aligned with the pin holes 33 on the key body 3, and two opposite through holes 52 respectively aligned with the retaining holes 34 on the key body 3.

Referring to FIG. 4 again, when assembled, the rubber cone 4 is supported on the printed circuit board 5 and received within the key body 3 with the annular top flange 41 extending into the center through hole 32 in the key body 3; the key body 3 is supported on the printed circuit board 5 and extends out of the key body slot 21 of the locating plate 2 to hold the rubber cone 4 on the inside with the downward stop rods 35 respectively stopped against the locating plate 2 at the top and the outward bottom flange 31 stopped against the locating plate 2 at the bottom; the key cap 1 is mounted on the key body 3 with the bottom plunger 11 stopped against the annular top flange 41 of the rubber cone 4, the opposite bottom rods 12 respectively and movably inserted into the pin holes 33 on the key body 3, and the opposite bottom hooks 13 respectively and movably hooked in the retaining holes 34 on the key body 3. Therefore, pressing the key cap 1 causes the bottom plunger 11 to press against or squeeze the annular top flange 41 of the rubber cone 4. When squeezed by the bottom plunger 11, the rubber cone 4 is forced to deform permitting the conductive rubber 42 to be moved downward to electrically connect the respective circuit on the printed circuit board 5, and therefore a specific input signal is sent by the keyboard to a computer or the like. Because the printed circuit board 5 has pin holes 51 and through holes 52 for passing the bottom rods 12 and bottom hooks 13 during the down stroke of the bottom plunger 11 of the key cap 1, the total thickness of the key switch is greatly reduced. The arrangement of the rubber cone 4 equally distributes the pressure from the key cap 1 through all directions and prevents direct contact of the printed circuit board 5, and therefore the key cap 1 is kept on course during its movement and the printed circuit board 5 is protected from direct impact force.

While only one embodiment of the present invention has been shown and described, it will be understood that various modifications and changes could be made without departing from the spirit and scope of the invention.

What is claimed is:

1. A computer key switch comprising:

a printed circuit board;

a locating plate spaced above said printed circuit board, said locating plate having a key body slot;

a key body mounted on said printed circuit board and extended out of said locating plate through said key body slot, said key body comprising an outward bottom flange retained between said printed circuit board and said locating plate, two downward stop rods on two opposite sides of said key body respectively stopped against said locating plate at the top, a center through hole through a flat top surface of said key body disposed centrally therein, two opposite pin holes and two opposite retaining holes through the flat top surface of said key body, and alternatively spaced around said center through hole;

a rubber cone made gradually smaller toward the top and received within said key body, said rubber cone comprising an annular top flange extended into the center through hole of said key body and a conductive rubber on the inside spaced above said printed circuit board;

a key cap mounted on said key body at the top, said key cap comprising a bottom plunger stopped against the annular top flange of said rubber cone, two opposite bottom rods respectively inserted into the two opposite pin holes on said key body, and two opposite bottom hooks respectively hooked in the two opposite retaining holes on said key body; and said printed circuit board including two opposite pin holes and two opposite through holes for passing therethrough the bottom rods and bottom hooks of said key cap as said key cap is depressed;

whereby when the annular top flange of said rubber cone is squeezed by the bottom plunger of said key cap, said rubber cone is deformed, and the conductive rubber of said rubber cone is moved down to connect with a switch on said printed circuit board, and a circuit is triggered.

* * * * *